US007686598B2

(12) United States Patent
Williams

(10) Patent No.: US 7,686,598 B2
(45) Date of Patent: Mar. 30, 2010

(54) DOWNHOLE PUMPS WITH SAND SNARE

(75) Inventor: Benny J. Williams, Godley, TX (US)

(73) Assignee: Harbison-Fischer, Inc., Crowley, TX (US)

( * ) Notice: Subject to any disclaimer, the term of this patent is extended or adjusted under 35 U.S.C. 154(b) by 509 days.

(21) Appl. No.: 11/645,872

(22) Filed: Dec. 27, 2006

(65) Prior Publication Data

US 2007/0154324 A1 Jul. 5, 2007

Related U.S. Application Data

(60) Provisional application No. 60/755,916, filed on Jan. 3, 2006.

(51) Int. Cl.
*F04B 39/00* (2006.01)

(52) U.S. Cl. ..... 417/430; 417/545; 417/546; 417/552; 417/555.1; 417/555.2

(58) Field of Classification Search ..... 417/56, 417/60, 555.2
See application file for complete search history.

(56) References Cited

U.S. PATENT DOCUMENTS

| | | | | | |
|---|---|---|---|---|---|
| 528,436 | A * | 10/1894 | Jones | 92/174 |
| 1,313,245 | A * | 8/1919 | Andrews | 417/53 |
| 1,545,475 | A * | 7/1925 | Adams | 417/430 |
| 1,549,175 | A * | 8/1925 | Reilly et al. | 417/258 |
| 3,479,958 | A * | 11/1969 | Anderson et al. | 417/437 |
| 4,968,226 | A * | 11/1990 | Brewer | 417/435 |
| 5,018,581 | A | 5/1991 | Hall | |
| 5,660,534 | A | 8/1997 | Snow | |
| 6,145,590 | A | 11/2000 | Havard | |
| 6,273,690 | B1 | 8/2001 | Fischer, Jr. et al. | |
| 6,481,987 | B2 | 11/2002 | Ford | |
| 6,905,114 | B2 | 6/2005 | Ford | |
| 6,926,504 | B2 * | 8/2005 | Howard | 417/417 |
| 6,945,762 | B2 | 9/2005 | Williams | |
| 6,966,248 | B2 | 11/2005 | Mahoney | |
| 7,008,197 | B2 | 3/2006 | Ford | |
| 7,404,702 | B2 | 7/2008 | Ford | |
| 7,428,923 | B2 | 9/2008 | Ford | |
| 7,458,787 | B2 * | 12/2008 | Brown | 417/555.2 |
| 2005/0226752 | A1 * | 10/2005 | Brown | 417/555.1 |
| 2005/0265875 | A1 * | 12/2005 | Williams et al. | 417/555.1 |
| 2006/0083646 | A1 * | 4/2006 | Ford | 417/555.1 |
| 2008/0179560 | A1 | 7/2008 | Ford | |
| 2008/0217565 | A1 | 9/2008 | Ford | |
| 2009/0053087 | A1 | 2/2009 | Ford | |
| 2009/0068042 | A1 | 3/2009 | Ford | |

* cited by examiner

*Primary Examiner*—Devon C Kramer
*Assistant Examiner*—Bryan Lettman
(74) *Attorney, Agent, or Firm*—Geoffrey A. Mantooth

(57) ABSTRACT

A downhole pump has a barrel and a plunger which reciprocate with respect to each other. The plunger has a first portion with a first seal, a second portion and a third portion with a second seal. The second portion is intermediate the first and second portions. A balancing chamber is formed between the plunger second portion and the barrel. The balancing chamber communicates with the plunger interior by way of an opening. A sand snare chamber is provided with respect to the opening so as to prevent sand from contacting the seals in the balancing chamber.

15 Claims, 6 Drawing Sheets

DOWNHOLE PUMPS WITH SAND SNARE

This application claims the benefit of U.S. Provisional application Ser. No. 60/755,916, filed Jan. 3, 2006.

FIELD OF THE INVENTION

The present invention relates to subsurface, or downhole, pumps, such as are used to pump oil and other fluids and bases from oil wells.

BACKGROUND OF THE INVENTION

When an oil well is first drilled and completed, the fluids (such as crude oil) may be under natural pressure that is sufficient to produce on its own. In other words, the oil rises to the surface without any assistance.

In many oil wells, and particularly those in fields that are established and aging, natural pressure has declined to the point where the oil must be artificially lifted to the surface. A subsurface pump is located down in the well below the level of the oil. A string of sucker rods extends from the pump up to the surface to a pump jack device, or beam pump unit. A prime mover, such as a gasoline or diesel engine, or an electric motor, or a gas engine, on the surface causes the pump jack to rock back and forth, thereby moving the string of sucker rods up and down inside of the well tubing.

The string of sucker rods operates the subsurface pump. A typical pump has a plunger that is reciprocated inside of a barrel by the sucker rods. The barrel has a standing one-way valve, while the plunger has a traveling one-way valve, or in some pumps the plunger has a standing one-way valve, while the barrel has a traveling one-way valve. Reciprocation charges a compression chamber between the valves with fluid and then lifts the fluid up the tubing toward the surface.

In some wells, sand in the well fluid is a problem. The sand abrades the upper parts of the plunger and may even enter between the plunger and the barrel, thereby degrading the fluid seal between the plunger and the barrel. Pump components in a sandy well require frequent replacement.

SUMMARY OF THE INVENTION

The present invention provides a downhole pump. The downhole pump comprises a barrel and a plunger. The barrel has a first one-way valve. The plunger is located in the barrel so that one of the plunger or the barrel reciprocates with respect to the other of the plunger or the barrel. The plunger has an interior passage therethrough. The plunger has a second one-way valve. The plunger and the barrel form a compression chamber between the first and second one-way valves. The plunger has a first portion with a first seal with the barrel. The plunger has a second portion that forms a balancing chamber between the barrel and the plunger. The plunger second portion has an opening so as to allow communication between the plunger interior passage and the balancing chamber. A wall is located relative to the opening so as to form a sand snare chamber between the balancing chamber and the plunger interior passage. The plunger has a third portion. The plunger second portion is interposed between the plunger first and third portions. The plunger third portion has a second seal with the barrel.

In accordance with one aspect of the present invention, the first seal comprises resilient members.

In accordance with another aspect of the present invention, the first seal comprises valve cups.

In accordance with still another aspect of the present invention, the first seal comprises an outside diameter that forms a fluid seal with the barrel.

In accordance with another aspect of the present invention, the second seal comprises an outside diameter that forms a fluid seal with the barrel.

In accordance with still another aspect of the present invention, the plunger third portion comprises a spray metal finish on the outside diameter.

In accordance with still another aspect of the present invention, the second seal comprises resilient members.

In accordance with another aspect of the present invention, the second seal comprises valve cups.

In accordance with another aspect of the present invention, the wall extends beyond the opening a distance so as to create a quiet zone between the wall and the plunger second portion.

In accordance with another aspect of the present invention, the wall surrounds a circumference of the plunger second portion and the wall extends from the plunger third portion toward the plunger first portion. The opening is located closer to the plunger third portion than to the plunger first portion.

In accordance with another aspect of the present invention, the first seal comprises resilient members which are valve cups, the second seal comprises an outside diameter that forms a fluid seal with the barrel. The wall surrounds a circumference of the plunger second portion and the wall extends from the plunger third portion toward the plunger first portion. The opening is located closer to the plunger third portion than to the plunger first portion. The wall extends beyond the opening a distance so as to create a quiet zone between the wall and the plunger second portion.

In accordance with still another aspect of the present invention, the first and second seals comprise resilient members.

In accordance with still another aspect of the present invention, the second seal comprises resilient members and a fluid seal.

The present invention also provides a method of pumping fluid from a sandy downhole well. The plunger is provided with two sets of seals. The plunger is reciprocated with respect to a barrel. Pressure across one set of seals is equalized by venting pressure from an inside of the plunger to an outside of the plunger at a location intermediate the two sets of seals. At the intermediate location, sand from the fluid is captured so as to isolate the sand from the sets of seals.

In accordance with one aspect of the present invention, the step of capturing the sand from the fluid further comprises providing a barrier between a location where pressure is vented and the barrel.

In accordance with another aspect of the present invention, the step of providing a plunger with two sets of seals further comprises providing a plunger with a first set of seals comprising resilient members and with a second set of seals comprising a fluid seal.

DESCRIPTION OF THE PREFERRED EMBODIMENT

Figure 1:
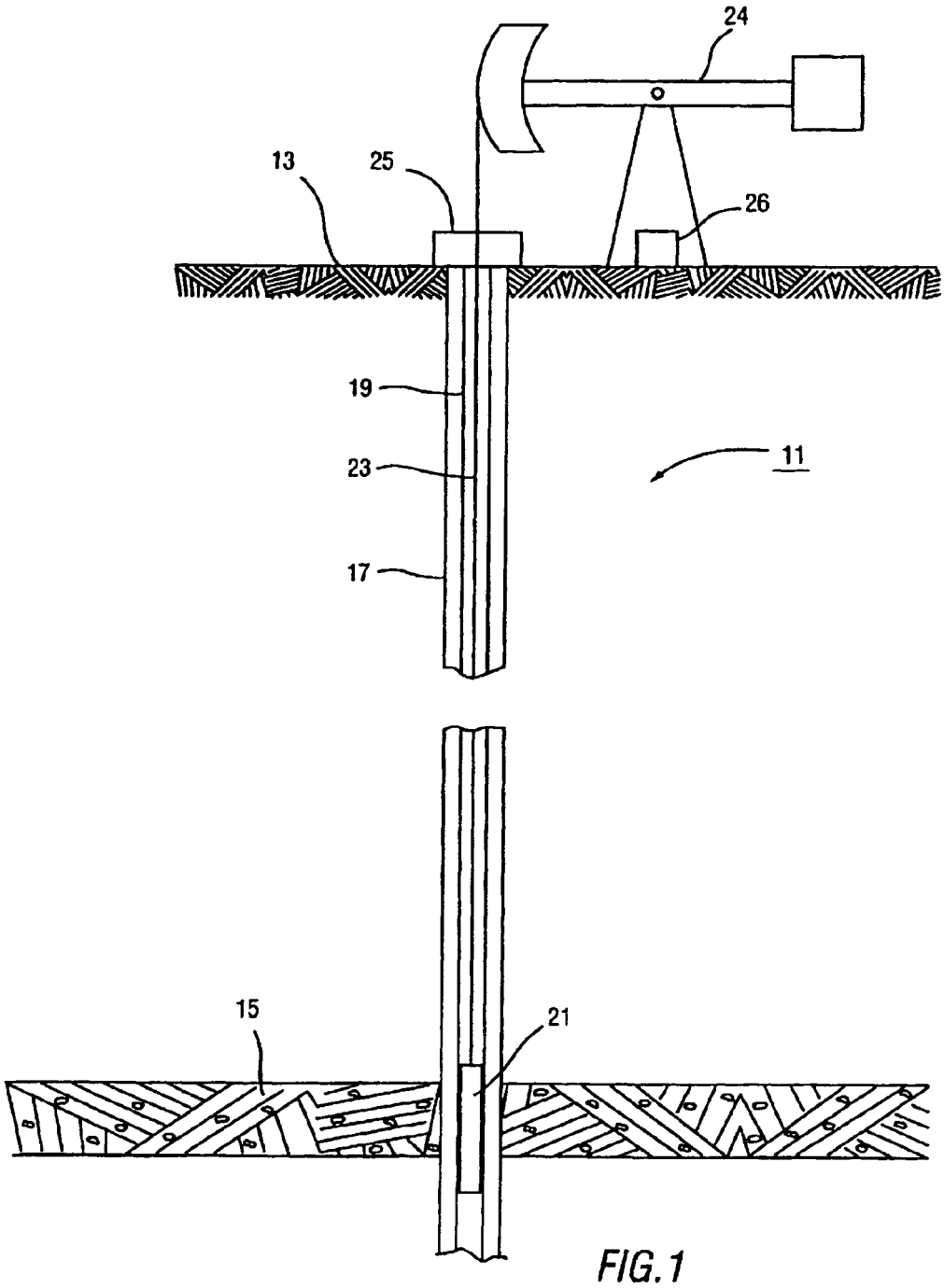
FIG. 1 is a schematic diagram of a well, shown with pumping equipment.

In FIG. 1, there is shown a schematic diagram of a producing oil well 11. The well has a borehole that extends from the surface 13 into the earth, past an oil bearing formation 15.

The borehole has been completed and therefore has casing 17 which is perforated at the formation 15. A packer or other device or method (not shown) optionally isolates the formation 15 from the rest of the borehole. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod and a stuffing box 25 on the surface 13. The sucker rod string 23 is connected to a pump jack unit, or beam pump unit, 24 which reciprocates up and down due to a prime mover 26, such as an electric motor or gasoline or diesel engine, or gas engine.

The present invention can be used with a variety of surface drive units besides a beam pump unit 24. For example, hydraulic pump units can be used, as well as belt type lifting units. Also, the present invention can be used with a variety of connecting members besides sucker rods 23. For example, a wire line can be used.

Figure 2:
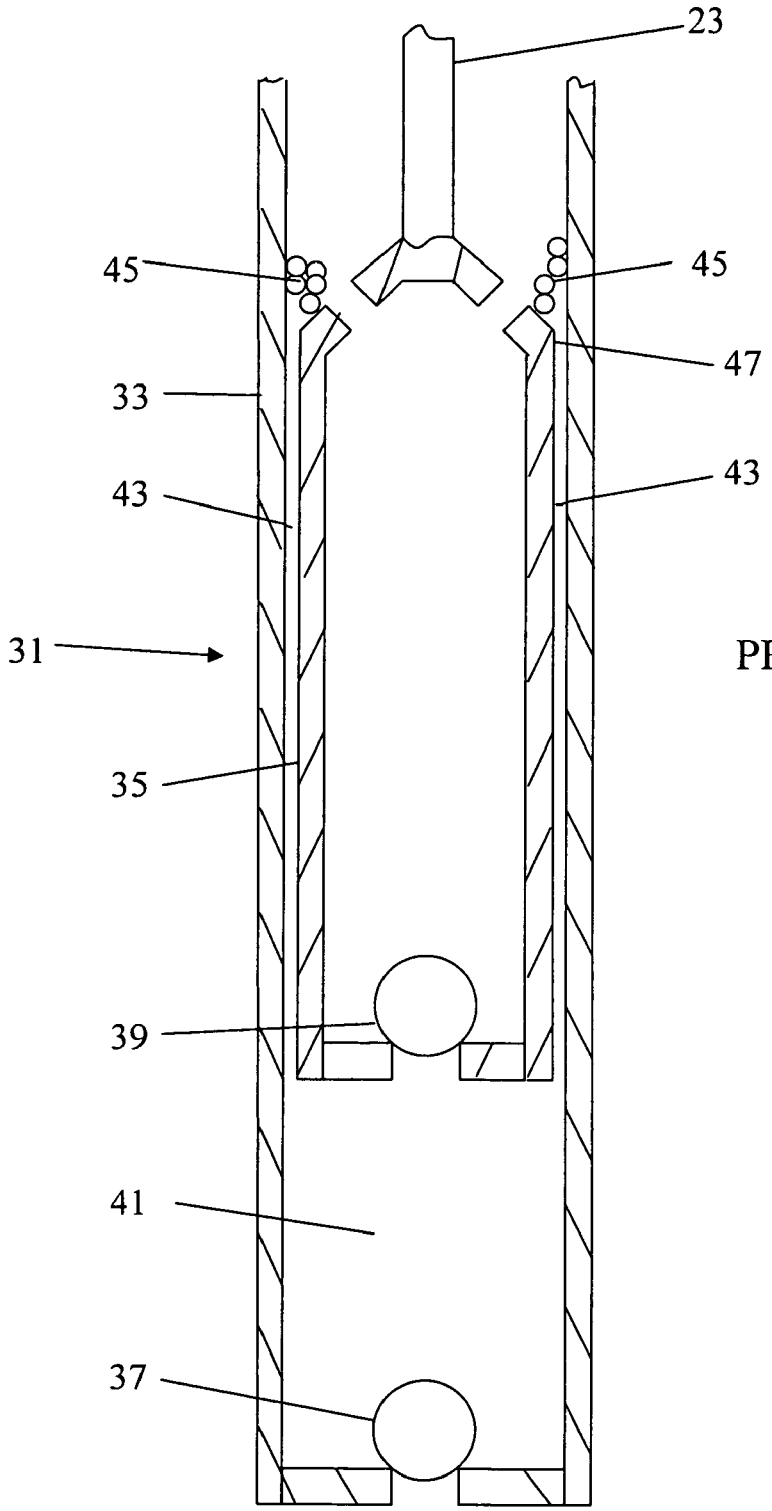
PRIOR ART FIG. 2
FIG. 2 is a longitudinal cross-sectional schematic view of a prior art pump.

FIG. 2 illustrates a prior art pump 31. The pump has a barrel 33 and a plunger 35. The plunger 35 reciprocates with respect to the barrel 33. The barrel has a standing valve 37 and the plunger has a traveling valve 39. In the illustrations, the valve cage and other details are not shown.

The plunger 35 is reciprocated by the sucker rods 23. As the plunger 35 is raised on the upstroke, the traveling valve 39 is closed and the standing valve 37 is opened, wherein fluid is drawn into the compression chamber 41 between the two valves 37, 39. Thus, on the upstroke, the compression chamber 41 is charged with fluid. The fluid above the traveling valve 39 is lifted toward the surface. As the plunger 35 descends on the downstroke, the traveling valve 39 opens and the standing valve 37 closes, thereby forcing the fluid in the compression chamber 41 into the plunger.

The outside diameter of the plunger 35 is sized so as to provide a fluid seal 43 between the plunger and the barrel. The fluid seal is formed by the fluid entering a clearance between the plunger and the barrel. This clearance is typically 0.002-0.008 inches.

If the fluid contains sand 45, the plunger 35 exhibits wear. This is because on the upstroke, the plunger 35 moves up into the sand 45 that is just above the plunger. The top end 47 of the plunger 35 exhibits the most wear from the sand due to the upstroke motion and due to fluid pressure. The column of fluid in the tubing extending to the surface exerts pressure on the top end of the plunger. This fluid pressure tends to force fluid with sand between the plunger 35 and the barrel 33, independently of the movement of the plunger.

Figure 3:
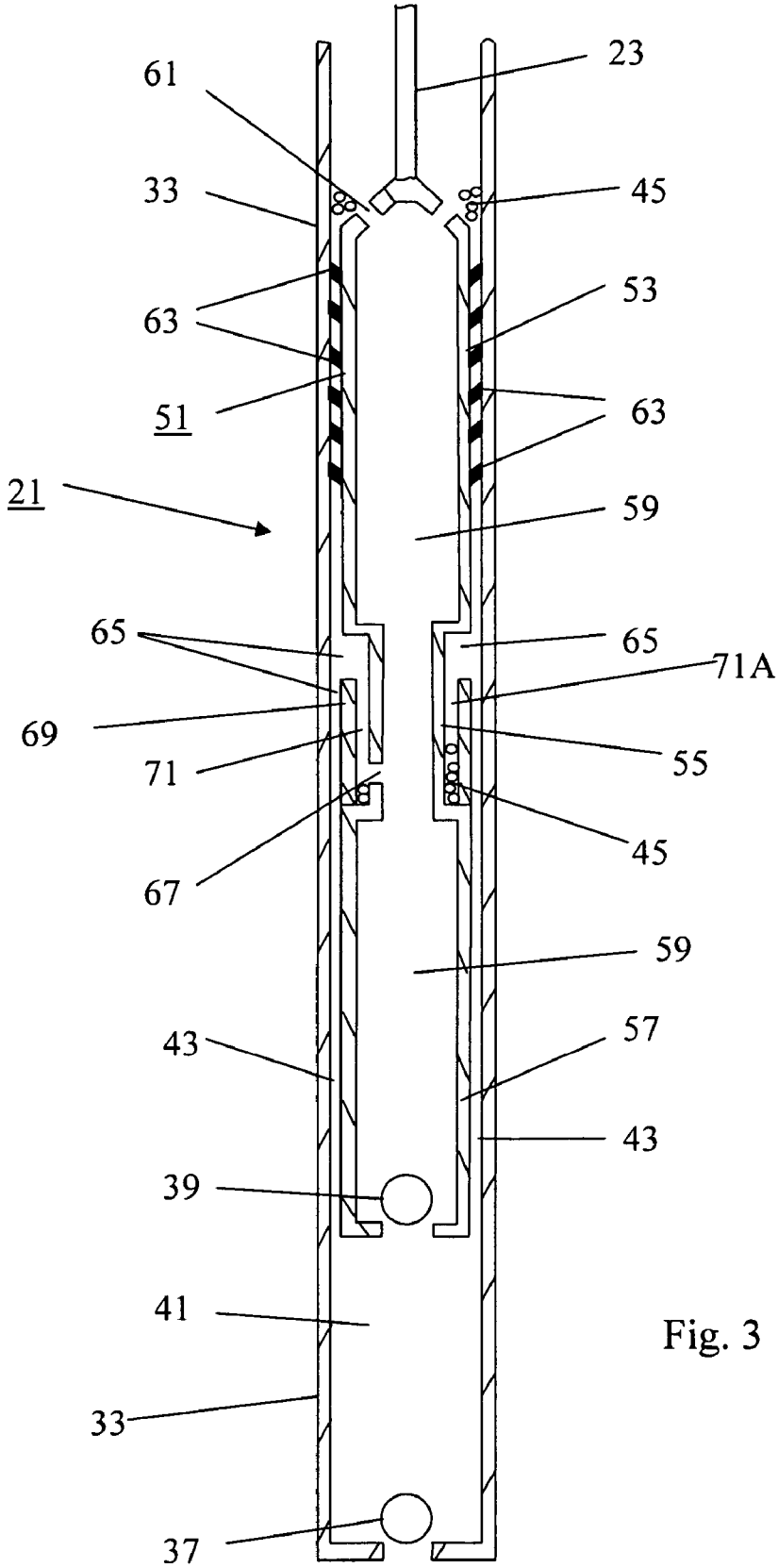
FIG. 3 is a longitudinal cross-sectional schematic view of a pump of the present invention, in accordance with a preferred embodiment.

With the pump 21 of the present invention, the plunger 51 is modified so as to minimize damage and abrasion caused by the sand. FIG. 3 illustrates the pump 21 of the present invention. Like parts from one figure to another have like reference numbers. Thus, the barrel 33 and valves 37, 39 are substantially similar in the two pumps 21, 31.

The generally cylindrical plunger 51 has several parts or portions. The plunger 51 has a first portion 53, a second portion 55 and a third portion 57. Because the pump 21 is typically oriented vertically, as shown, this orientation will be used to describe the pump. Thus, the plunger first portion 53 is above the second and third portions 55, 57. The plunger second portion 55 is interposed between the plunger first and third portions 53, 57. The pump 21 can be used in a non-vertical orientation, and can even be used in a horizontal orientation. An internal passage 59 extends along the length of the plunger, through all portions 53, 55, 57. The internal passage 59 extends from the traveling valve 39 to openings 61 in the upper end of the plunger. These openings 61 communicate with the tubing 19 that extends to the surface.

The plunger first portion 53 is equipped with seals 63 around the circumference. The seals 63 form a seal against the barrel 33 inside diameter. In the preferred embodiment, the seals are conventional and commercially available valve cups, although other types of seals can be used. For example, the seals can be of elastomeric material and have a fiber component. Because the seals 63 will be abraded and worn by the sand 45 during pumping operations, a number of seals are used. For example, in one embodiment, twelve valve cups are used, with the valve cups positioned along the length of the plunger first portion 53.

The plunger second portion 55 has a reduced diameter so as to form a balancing chamber 65 in the barrel between the first and third portions 53, 57 of the plunger. The plunger second portion 55 has an opening 67 that allows communication between the plunger internal passage 59 and the balancing chamber 65. The opening 67 is sized large enough so that it will not become blocked or occluded by sand. For example, the opening can be ½ to 1 inch in diameter. A wall 69 extends upward, past the opening 67, to form a sand snare chamber 71. The sand snare chamber 71 communicates with the balancing chamber. In the preferred embodiment, the wall 69 extends from the lower end of the second portion toward the plunger first portion. The wall 69 is cylindrical and surrounds the opening 67. The wall 69, and thus the sand snare chamber 71, is located so as to capture sand that enters the balancing chamber 65 by way of the opening 67. In the preferred embodiment, the opening 67 is located close to the bottom end of the plunger second portion 55. The wall 69 extends up past the opening for some distance. In a preferred embodiment, the wall 69 extends past the opening 67 five to eight inches.

The plunger third portion 57 is cylindrical. The outside diameter of the plunger third portion 57 is slightly smaller than the inside diameter of the barrel 33. The clearance between the plunger third portion 57 and the barrel 33 is sized so that fluid can enter and provide a fluid seal 43. This fluid seal is also known as a metal-to-metal clearance seal. In the preferred embodiment, the clearance is 0.002-0.008 inches. The larger clearances are for heavy crude, large plungers or heavy particulate conditions.

As one option, the outside diameter of the plunger third portion 57 can be hardened for increased wearability and durability. For example, the plunger third portion can be sprayed with metal such as nickel-based spray powder. The outer spray metal layer is typically 0.01 inches thick on each side, or 0.020 inches in total cross-section. The hardness is typically Rockwall C 50 or C 60. Of course other types of hardening methods and materials can be used, as well as other thicknesses of hardening coats.

In the preferred embodiment, the plunger portions 53, 55, 57 are joined together with couplings. This allows replacement of an individual component rather than the plunger 51 as a whole. In the preferred embodiment, the plunger first portion 53 is joined to the plunger second portion 55 by way of a coupling having female threads that receives an end of the plunger second portion. The same type of coupling is used to join the plunger second portion to the plunger third portion. The plunger second portion is a connecting tube having male threads on each end. These male threads receive the individual couplings. The coupling joining the second and third portions also has external male threads for receiving the wall 69. The wall 69 can be a length of a small diameter barrel.

In operation, the plunger 51 and the barrel 33 have reciprocal motion relative to one another. In a fixed barrel pump, the plunger is reciprocated. In a fixed plunger pump, the barrel is reciprocated.

Using as an example a fixed barrel pump, the plunger has a seal provided by the resilient members 63 and another seal 43 provided by the fluid inside of the small clearance. Sand 45 from the tubing enters the top of the clearance between the plunger first portion 53 and the barrel 33. As the plunger 51 reciprocates, the seals 63 on the plunger first portion 53 isolate the balancing chamber 65 from the remainder of the pump. This minimizes sand from entering the balancing chamber 65 from the top of the overall plunger 51. Furthermore, during reciprocation, the seals 63 wipe the inside surface of the barrel, wiping sand that may adhere to the barrel.

Normally, in prior art pumps, the seals 63 would have a short life and would require frequent replacement. That is why most downhole pumps utilize a plunger that relies on a fluid seal as described with respect to FIG. 2. However, the first portion 53 of the plunger has no pressure differential across it. The openings 61, 67 provide that the first portion upper end is at the same pressure as the balancing chamber 65 and thus the first portion lower end. This equal pressure across the plunger first portion 53 and its seals 63 greatly reduces the wear on these seals.

The opening 67 in the plunger second portion not only equalizes pressure across the seals, but it also allows sand to enter the balancing chamber 65. However, the sand is captured or snared in order to prevent the sand from contacting the top end of the plunger third portion 57. The snare is formed by the wall 69 and the sand snare chamber 71. The wall 69 forms a barrier around the opening 67. On the downstroke, fluid flows through the internal passage 59 of the plunger 51. Some sand may pass through the opening 67 and enter the sand snare chamber 71. The sand snare chamber has little or no fluid flow therein. To the extent that there is fluid flow inside the sand snare chamber 71, any sand entering through the opening is confined to the sand snare chamber and does not enter the balancing chamber 65. Thus, the sand is confined and does not contact the barrel 33 in the balancing chamber 65, nor does sand contact the top end of the plunger third portion 57.

The volume of the sand snare chamber 71 can be large relative to the volume of the balancing chamber 65. In other words, the wall 69 can be placed close to the barrel 33. The sand snare chamber 71 is sized sufficiently large so that any volume of fluid flow through the opening 67 is confined within the sand snare chamber 71. The wall 69 forms a quiet zone above the opening 67. Any fluid flow into the sand snare chamber 71 is confined to the volume around the opening 67. In the chamber 71 volume located between the opening 67 and the balancing chamber 65, little or no flow occurs. In the preferred embodiment, this volume 71A is located above the opening and is a quiet zone because little or no fluid flow occurs.

The plunger third portion 57 forms a fluid seal and carries the pressure differential across it, much like a conventional plunger 35.

Figure 4:
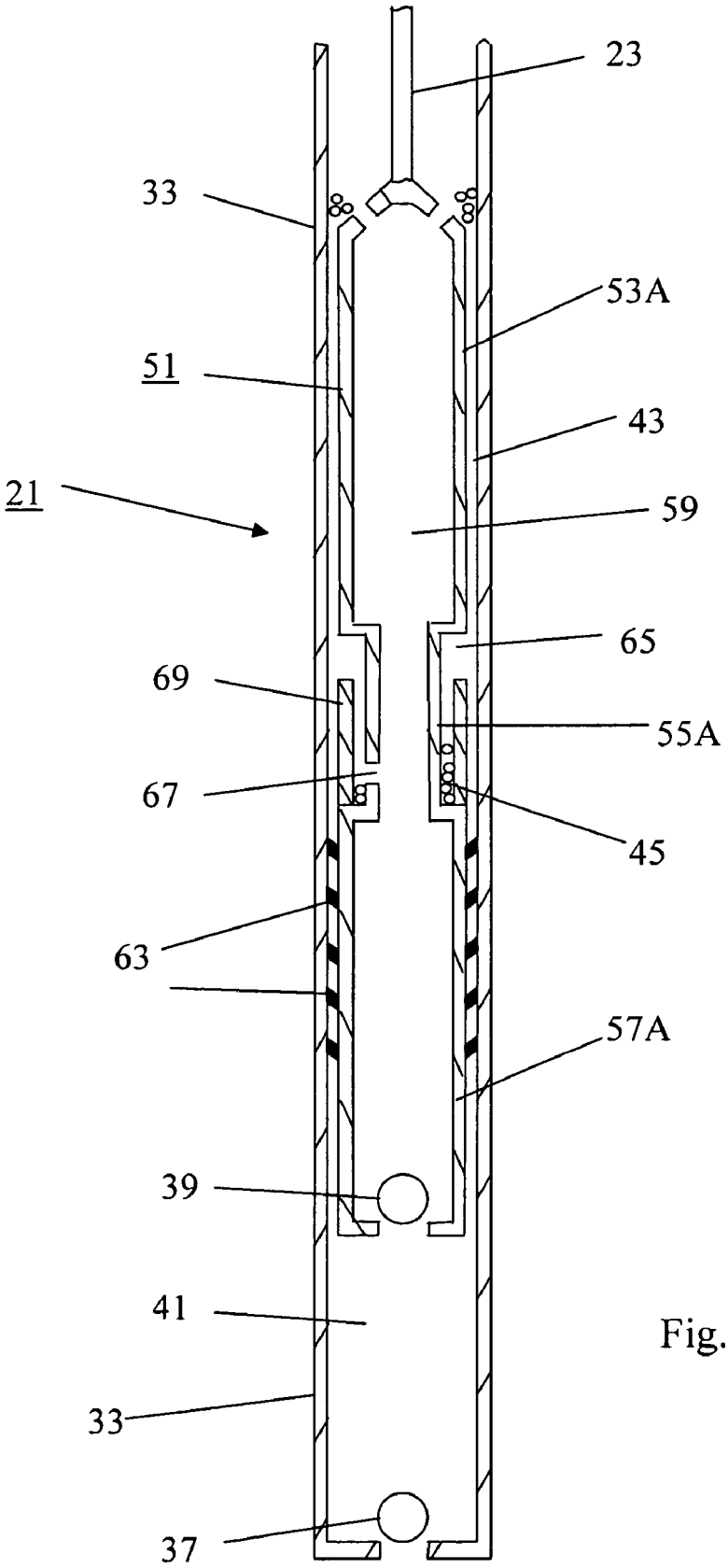
FIG. 4 is a longitudinal cross-sectional schematic view of a pump of the present invention, in accordance with another embodiment.

FIG. 4 shows another embodiment. The plunger has first, second and third portions 53A, 55A, 57A. The seals between the plunger and the barrel are in a different arrangement from the embodiment of FIG. 3. The first portion 53A uses a metal-to-metal clearance seal or a fluid seal 43. This is the same type of seal used by the third portion 57 in the embodiment of FIG. 3. The third portion 57A of FIG. 4 can be a metal-to-metal clearance seal 43. Alternatively, as shown in FIG. 4, the third portion can have seals 63, which seals are the same as discussed above with respect to FIG. 3.

The balancing chamber 65 in FIG. 4 equalizes the pressure across the fluid seal 43. This minimizes pressure driving sand into the upper end of the fluid seal 43. The seals 63 on the plunger third portion 57A wipe the inside of the barrel free of sand on each stroke, extending the useful life of the fluid seal 43.

The embodiment of FIG. 4, where the fluid seal 43 is above or uphole relative to the resilient seals 63, is also useful where the traveling valve 39 is located at or near the upper end of the plunger 51. In this case, the balancing chamber 65 equalizes pressure across the resilient seals 63.

The present invention splits the function of the plunger into one portion, which provides a seal suitable for sand, and another portion, which provides a seal suitable for fluid. By providing components that are specialized to their function, the life of the overall plunger is prolonged in sandy wells.

Figure 5:
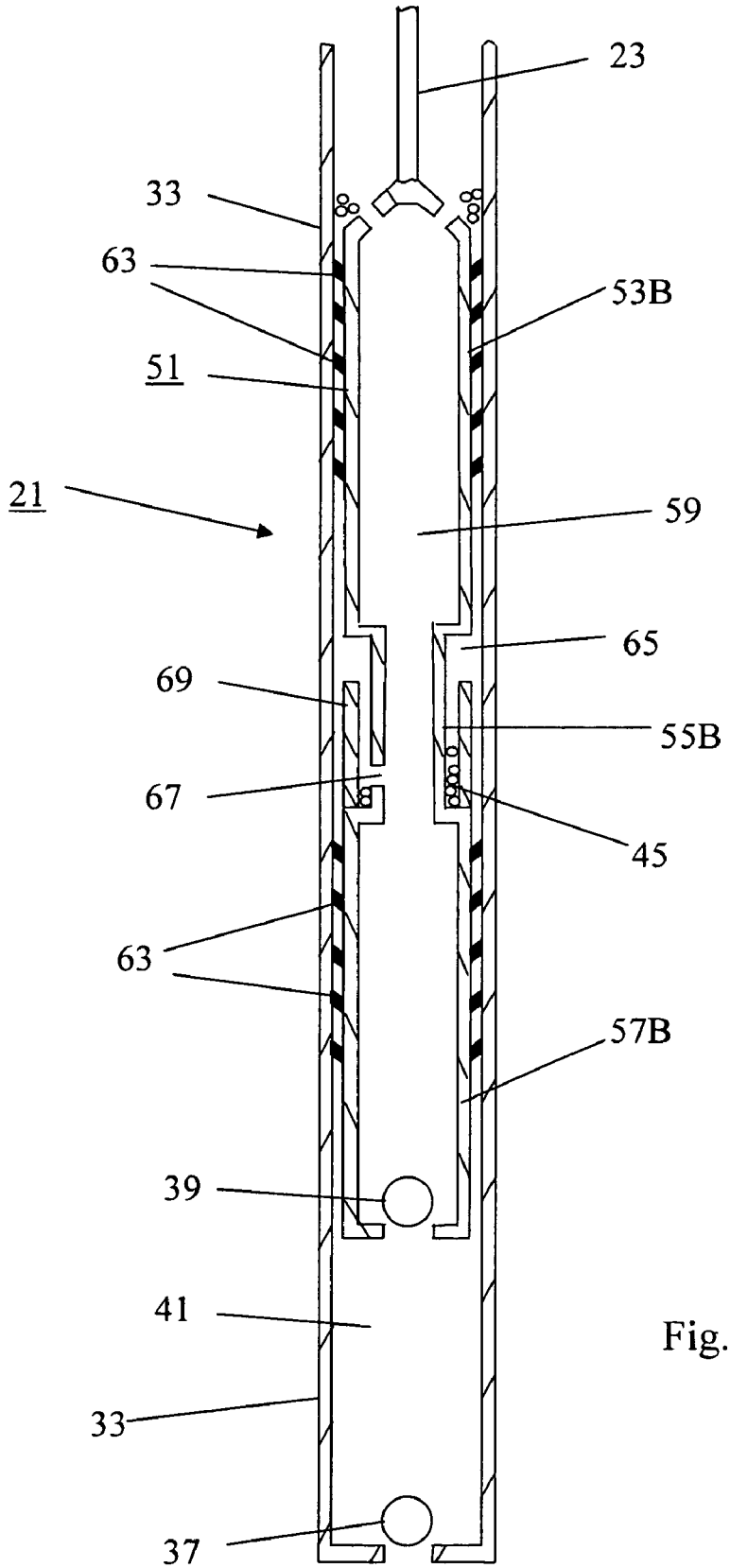
FIG. 5 is a longitudinal cross-sectional schematic view of a pump of the present invention, in accordance with still another embodiment.

FIG. 5 shows another embodiment of the pump. The plunger has first, second and third portions 53B, 55B, 57B. The first portion 53B and the third portion 57B have resilient seals 63. Providing resilient seals on both the upper and lower plunger portions 53B, 57B eliminates slippage. Slippage occurs in a fluid seal 43; the fluid slips through the clearance between the barrel and the plunger for lubrication purposes. Slippage also allows the entry of sand into the clearance between the barrel and the plunger. The sand causes wear. Resilient seals have no slippage and consequently allow no sand into the clearance between the plunger and the barrel. There is hardly any wear on either the first or the third plunger portions 53B, 57B.

Figure 6:
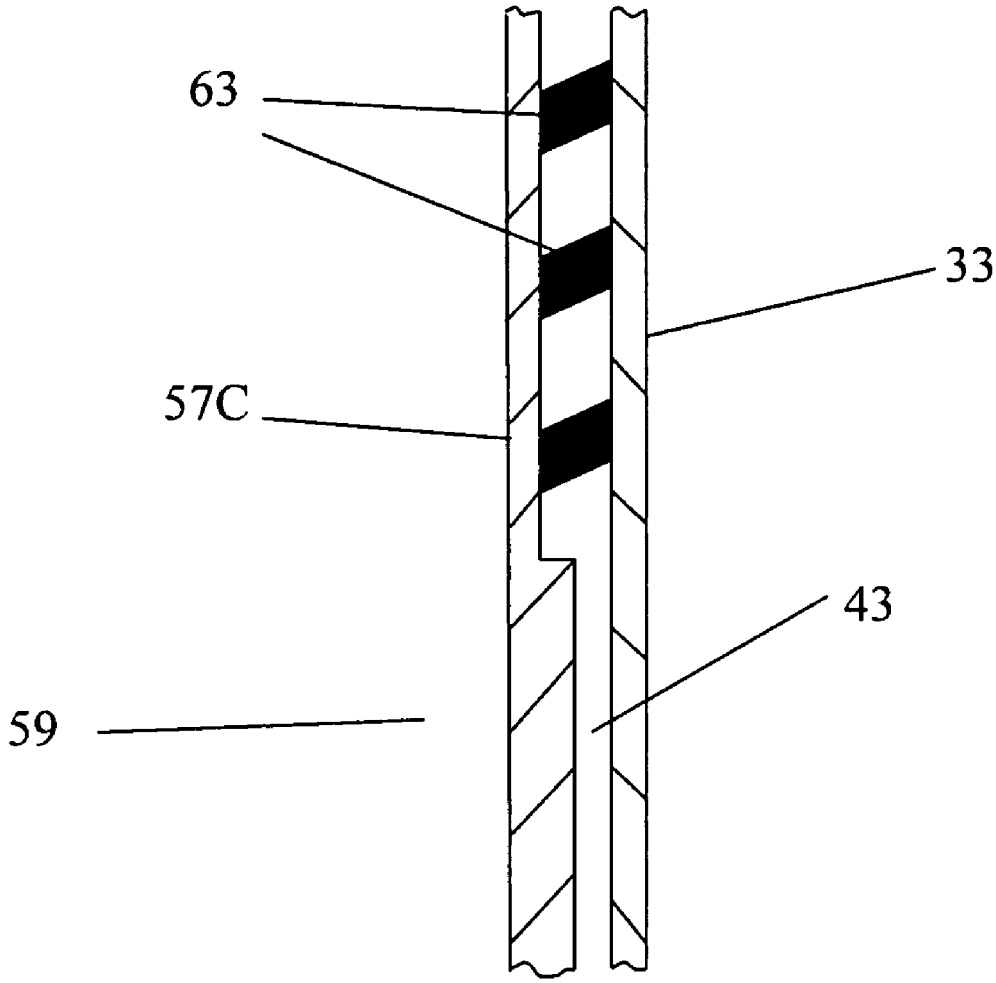
FIG. 6 is a detail longitudinal cross-sectional view of a plunger third portion, in accordance with still another embodiment.

FIG. 6 shows a plunger third portion 57C, in accordance with another embodiment. The plunger third portion 57C has two types of seals. One type is resilient seals 63. The resilient seals are located at one end of the third portion 57C and prevent the entry of sand into the clearance between the plunger and the barrel. The other type of seal is a fluid seal 43, which is located along the remainder of the length of the plunger third portion 57C. The outside diameter of the third portion changes to accommodate the types of seals. Thus, the outside diameter of the plunger is smaller at the resilient seals 63 than at the fluid seal 43.

Thus, a combination of resilient seals and fluid seals can be used. Resilient seals prevent the entry of sand into the clearance between the plunger and barrel. Providing a balancing chamber reduces the pressure differential across the resilient seals. Fluid seals are better suited to wear when subjected to pressure differentials but exhibit wear due to sand.

The invention can be utilized on insert-type pumps and tubing-type pumps. The invention can be used on stationary barrel-type pumps, regardless of whether the barrel is top anchored or bottom anchored. The invention can also be used on traveling barrel-type pumps.

The foregoing disclosure and showings made in the drawings are merely illustrative of the principles of this invention and are not to be interpreted in a limiting sense.

The invention claimed is:

1. A downhole pump, comprising:

a) a barrel having a first one-way valve;

b) a plunger located in the barrel so that one of the plunger or the barrel reciprocates with respect to the other of the plunger or the barrel, the plunger having an interior passage therethrough, the plunger having a second one-way valve, the plunger and the barrel forming a compression chamber between the first and second one-way valves;

c) the plunger having a first portion with a first seal with the barrel;

d) the plunger having a second portion that forms a pressure balancing chamber between the barrel and the plunger, the plunger second portion having an opening so as to allow communication between the plunger interior passage and the balancing chamber;

e) a wall located relative to the opening so as to form a sand snare chamber located in the balancing chamber, the wall coupled to the plunger;

f) the plunger having a third portion, the plunger second portion being interposed between the plunger first and third portions, the plunger third portion having a second seal with the barrel.

2. The downhole pump of claim 1 wherein the first seal comprises resilient members.

3. The downhole pump of claim 2 wherein the first seal comprises valve cups.

4. The downhole pump of claim 2 wherein the second seal comprises an outside diameter that forms a fluid seal with the barrel.

5. The downhole pump of claim 1 wherein the first seal comprises an outside diameter of the first portion that forms a fluid seal with the barrel.

6. The downhole pump of claim 1 wherein the second seal comprises an outside diameter that forms a fluid seal with the barrel.

7. The downhole pump of claim 6 wherein the plunger third portion comprises a spray metal finish on the outside diameter.

8. The downhole pump of claim 1 wherein the second seal comprises resilient members.

9. The downhole pump of claim 8 wherein the second seal comprises valve cups.

10. The downhole pump of claim 1 wherein the wall extends beyond the opening a distance so as to create a quiet zone between the wall and the plunger second portion.

11. A downhole pump, comprising:

a) a barrel having a first one-way valve;

b) a plunger located in the barrel so that one of the plunger or the barrel reciprocates with respect to the other of the plunger or the barrel, the plunger having an interior passage therethrough, the plunger having a second one-way valve, the plunger and the barrel forming a compression chamber between the first and second one-way valves;

c) the plunger having a first portion with a first seal with the barrel;

d) the plunger having a second portion that forms a pressure balancing chamber between the barrel and the plunger, the plunger second portion having an opening so as to allow communication between the plunger interior passage and the balancing chamber;

e) a wall located relative to the opening so as to form a sand snare chamber between the balancing chamber and the plunger interior passage;

f) the plunger having a third portion, the plunger second portion being interposed between the plunger first and third portions, the plunger third portion having a second seal with the barrel;

g) the wall surrounds a circumference of the plunger second portion and the wall extends from the plunger third portion toward the plunger first portion, the opening being located closer to the plunger third portion than to the plunger first portion, the wall mounted to the plunger.

12. The downhole pump of claim 1, wherein:

a) the first seal comprises resilient members;

b) the second seal comprises an outside diameter that forms a fluid seal with the barrel;

c) the wall surrounds a circumference of the plunger second portion and the wall extends from the plunger third portion toward the plunger first portion, the opening being located closer to the plunger third portion than to the plunger first portion;

d) the wall extends beyond the opening a distance so as to create a quiet zone between the wall and the plunger second portion.

13. The downhole pump of claim 1 wherein the first and second seals comprise resilient members.

14. The downhole pump of claim 1 wherein the second seal comprises resilient members and a fluid seal.

15. The downhole pump of claim 11 wherein the wall is non-rotatably mounted to the plunger.

* * * * *